United States Patent [19]

Leidy et al.

[11] 4,118,103

[45] Oct. 3, 1978

[54] DOUBLE-ENDED CONNECTING DEVICE

[75] Inventors: James Albert Leidy, Harrisburg; Gary Douglas Porta, Shiremanstown, both of Pa.

[73] Assignee: AMP Incorporated, Harrisburg, Pa.

[21] Appl. No.: 833,783

[22] Filed: Sep. 15, 1977

[51] Int. Cl.[2] ..... H01R 9/08

[52] U.S. Cl. ..... 339/98

[58] Field of Search ..... 339/97 R, 97 P, 98, 339/99 R

[56] References Cited

U.S. PATENT DOCUMENTS

| | | | |
|---|---|---|---|
| 3,617,983 | 11/1971 | Patton | 339/98 |
| 4,039,239 | 8/1977 | Cobaugh et al. | 339/97 R |

FOREIGN PATENT DOCUMENTS

| | | | |
|---|---|---|---|
| 1,640,630 | 10/1969 | Fed. Rep. of Germany | 339/97 R |
| 2,131,769 | 12/1972 | Fed. Rep. of Germany | 339/97 P |

*Primary Examiner*—Joseph H. McGlynn
*Attorney, Agent, or Firm*—Frederick W. Raring

[57] ABSTRACT

A double-ended electrical connecting device for connecting two wires to each other is generally U-shaped and comprises a web and sidewalls. The sidewalls are reversely bent inwardly towards each other and towards the web so that a double thickness of metal is provided in the upper portions of the sidewalls which are remote from the web. A wire-receiving opening is provided in the web and this opening merges with wire-receiving slots extending partially along the sidewalls. Additional wire-receiving slots extend inwardly from the upper free edges of the sidewalls through portions of the double thicknesses of metal. One wire is moved laterally of its axis and into each of the slots electrically to connect both wires to the connecting device and to each other.

9 Claims, 6 Drawing Figures

DOUBLE-ENDED CONNECTING DEVICE

BACKGROUND OF THE INVENTION

This invention relates to connecting means for connecting two or more wires to each other. The herein disclosed embodiment of the invention is particularly intended for connecting a relatively fine wire, such as an AWG 26 wire, which may extend from a coil to a relatively coarse wire, for example, an AWG 18 wire, which extends to other circuitry.

U.S. Pat. No. 3,979,615 discloses and claims a connecting means for connecting the relatively fine wires of a motor stator to the conductors which extend from the motor. The invention disclosed in that prior art patent comprises a connecting device which establishes an electrical connection with the stator windings by means of wire-receiving slots provided in the connecting device so that when the wire is moved laterally of its axis and into the slots, the varnish type insulation of the wire is penetrated and electrical contact is established. The term "displation" has been coined to define these wire-in-slot type electrical connections.

While the connecting device shown in the above-identified U.S. Pat. No. 3,979,615 provides a displation type connection between the coil wire and the terminal, it discloses other connecting means for connecting the terminal to the lead wire extending from the coil. The connecting means for the coarse lead wire may comprise a terminal crimped onto the lead wire which terminal is mated with a tab. It would be convenient to use or provide displation type connections between the terminal and both the lead wire and the extremely fine wire, however, there is quite often a wide disparity between the size of the lead wire and the size of the wire extending from the coil winding. The coil wire may be relatively fine, for example, AWG 26 and the lead wire may be relatively coarse, for example, AWG 18. Terminals or connecting devices for forming displation connections with fine wires must have relatively narrow slots and they must therefore be manufactured from relatively thin stock metal in order to permit the stamping of the required relatively narrow slots for the fine wire. The extremely thin stock metal used in the manufacture of such terminals is not suitable for forming displation type connections with coarse wires because of the fact that the metal is not sufficiently strong. Furthermore, thin metal stock may not provide sufficient area at the electrical interface for a good electrical connection. Hence, the above-identified U.S. Pat. No. 3,979,615 suggests that the lead wire be made by some means other than displation.

The instant invention is directed to the achievement of a double-ended connecting device which is capable of receiving an extremely fine wire at one end thereof and a coarse wire at the other end thereof to connect the wires to each other. The connecting device is manufactured with a double thickness of metal at the end thereof which receives the coarse wire and a single thickness at the end which receives the fine wire. The connecting device can thus be manufactured from a relatively thin stock metal so that a narrow slot can be provided at the fine wire-receiving end and the coarse wire-receiving end will have adequate strength and contact area to establish an affective electrical connection to the coarse wire. The connecting device is received in the cavity of an insulating housing with the fine wire-receiving end and the fine wire connection at the inner end of the cavity. This arrangement is extremely convenient in the stator manufacturing process in that the fine wire connections can be made at the time the coil is wound and they will be protected during subsequent handling of the stator. The construction of the connecting device and the insulation housing is such that the formation of the coarse wire connection does not disturb the electrical connection to the fine wire at the inner end of the housing.

It is accordingly an object of the invention to provide an improved connecting device for making displation type electrical connections to wires. A further object is to provide a double-ended connecting device for connecting a relatively fine wire to a relatively coarse wire. A further object is to provide an improved means for connecting lead wires to the tap wires of a coil or the like.

These and other objects of the invention are achieved in a preferred embodiment thereof which is briefly described in the foregoing abstract, which is described in detail below, and which is shown in the accompanying drawing in which.

Figure 5:
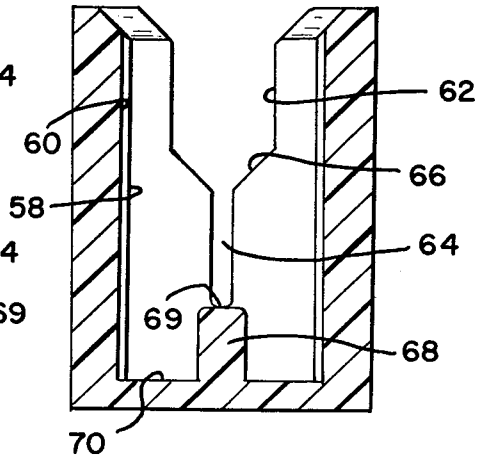
Figure 4:
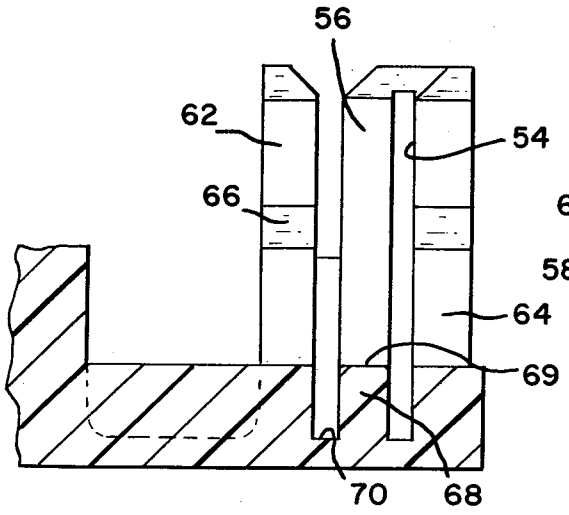
Figure 3:
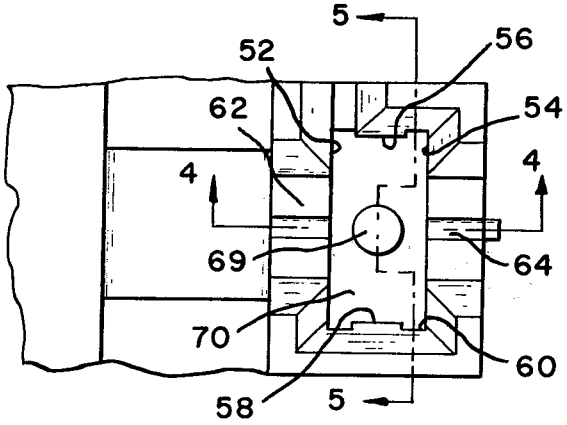
FIG. 3 is a plan view looking downwardly upon a housing which receives the terminal or connecting device of FIG. 1A.

FIGS. 4 and 5 are views taken along the lines 4—4 and 5—5 of FIG. 3.

Figure 1:
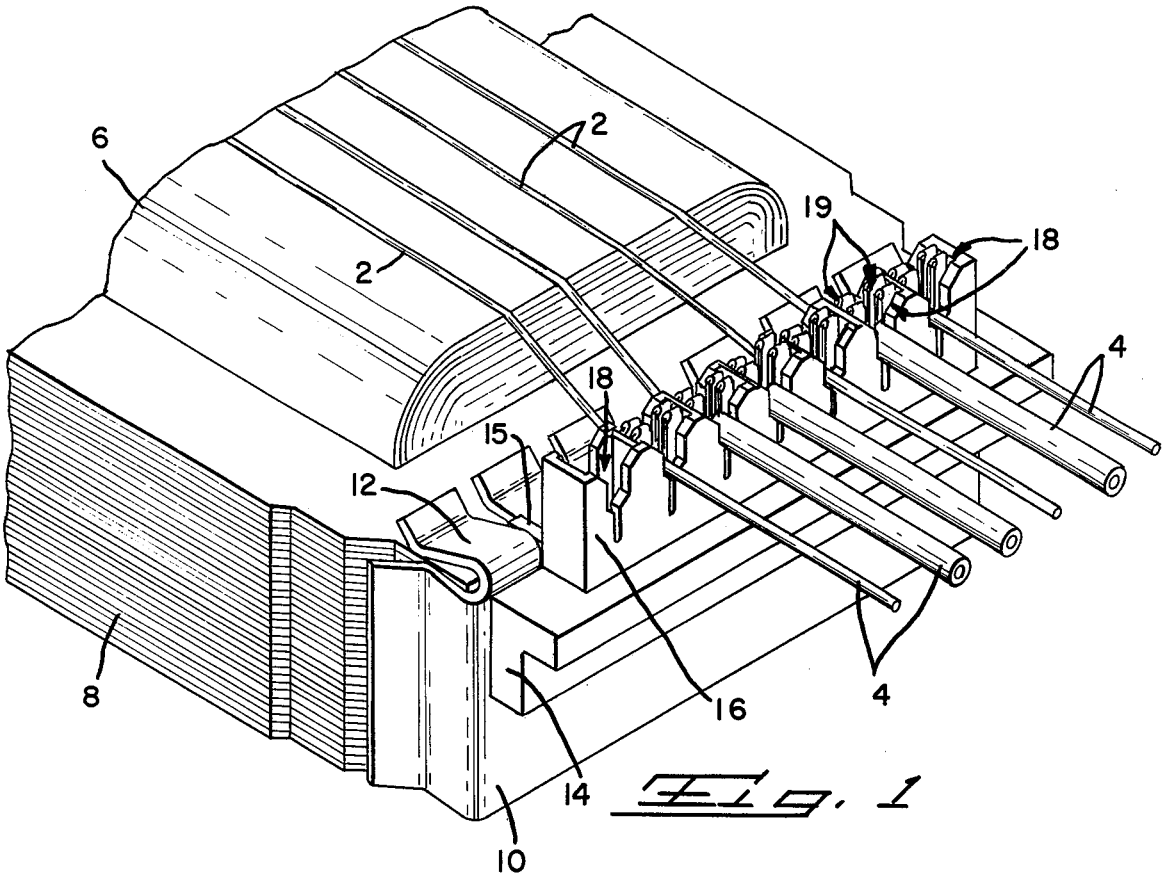
FIG. 1 is a perspective view of a portion of a transformer having connecting means in accordance with the invention thereon for connecting the windings of the transformer to external conductors.

The herein disclosed embodiment of the invention serves to connect the tap wires 2 of a coil 6 to external conductors 4 which may be of varying sizes as shown in FIG. 1. The coil 6 is positioned within a stack 8 of laminae which constitutes the core of a transformer and a metal clip 10 is mounted on the end of the stack as shown. The clip 10 has outwardly extending spring fingers 12 at its upper end which are reversely formed and are spaced-apart from each other. The electrical connections between the individual external conductors 4 and the coil wires 2 are made by terminal devices 19 which are received in cavities 18 in an insulating housing 16. The housing 16 is integral with an L-shaped mounting bar 14 which is disposed against the clip 10 and which was rearwardly extending fingers 15 which are received by the spring fingers 12 to hold the mounting bar in the housing 16 on the clip. It should be mentioned that the wires 2 will generally be relatively fine, for example, AWG 26 while the wires 4 may be relatively coarse, for example, AWG 18. The wires 2 will ordinarily have an extremely thin coating of varnish type insulation thereon, usually polyvinyl formal resin, while the wires 4 will have a relatively thick plastic insulating sheath over their conducting cores.

Each terminal 19 is generally U-shaped in cross section and comprises a web 20 and sidewalls 22 extending upwardly as viewed in the drawing from the sides of the web. The sidewalls are reversely folded as shown at 24 and extend downwardly from their upper free edges towards the web so that their lower ends 26 are spaced from the internal surface of the web 20. This arrangement provides a double thickness of metal in each sidewall and the inner layer of metal in each sidewall has inwardly formed bosses 28 which serve as stops and which stabilize the connecting device when a coarse wire is connected thereto as will be described below.

A fine wire-receiving opening 30 is provided in the web and this opening merges with fine wire-receiving slots 32 which extend upwardly from the web and partially towards the reversely folded free ends of the sidewalls. Advantageously, an insulation nicking edge 36 is provided on each edge of these slots at the entrance thereof. These nicking edges extend only a very slight distance beyond adjacent surface portions of the slots and they are formed by shearing the sidewalls along L-shaped shear lines 34, which extend from the edges laterally of the slots, and then forming the sheared portions of the sidewalls slightly out of the normal planes of the sidewalls. The sheared and deformed portions are then pressed into the planes of the sidewalls and this very slight working or forming has the effect of displacing a portion of the material shown at 35 inwardly of the slot so that the edges 36 are provided as discontinuities in the opposed edges of the slots 32.

The slots 32 must have a width of about 0.010 inches when the connecting device is intended to receive an AWG 26 wire in this slot and as a practical matter, the metal stock from which the connecting device is formed can not have a thickness which is significantly greater than about 0.01 inches. A connector in accordance with the instant invention, for example, can be manufactured from strip stock having a thickness of 0.0126 inches. Metal stock this thin is not sufficiently strong to be used for the manufacture of displation type connecting devices for coarse wires and the double thickness at the upper end of the device does permit the achievement of connections to coarse wires as will be described below.

A generally oval shaped opening 38 is provided at the inner end of each slot 32 which serves to prevent stress concentration and to control the spring characteristics of the sidewalls so that the desired contact force between wire and the edges of the slot will be achieved. The size and shape of the opening 38 may be varied to vary the spring characteristics of the sidewalls as required for a specific application of the invention. It will be noted that laterally extending barbs 40 are provided on each of the sidewalls 22 and these barbs cooperate with the cavity in the housing 16 as will also be described below.

The slots 44 which receive the coarse wires 4, extend downwardly from the upper end 24 of each sidewall in the double thickness sections of the sidewalls. These slots are flared at their upper ends 42 to assist in guiding the wires into the slots.

Figure 1A:
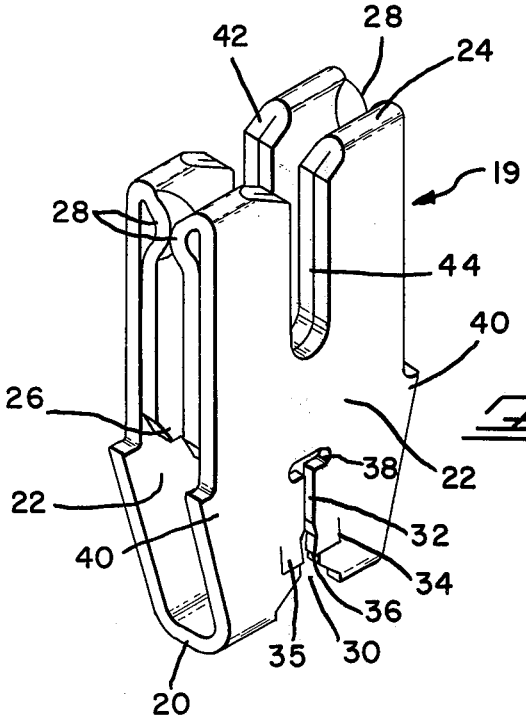
FIG. 1A is a perspective view of a metallic connecting device which receives a fine wire and a relatively coarse wire.
Figure 2:
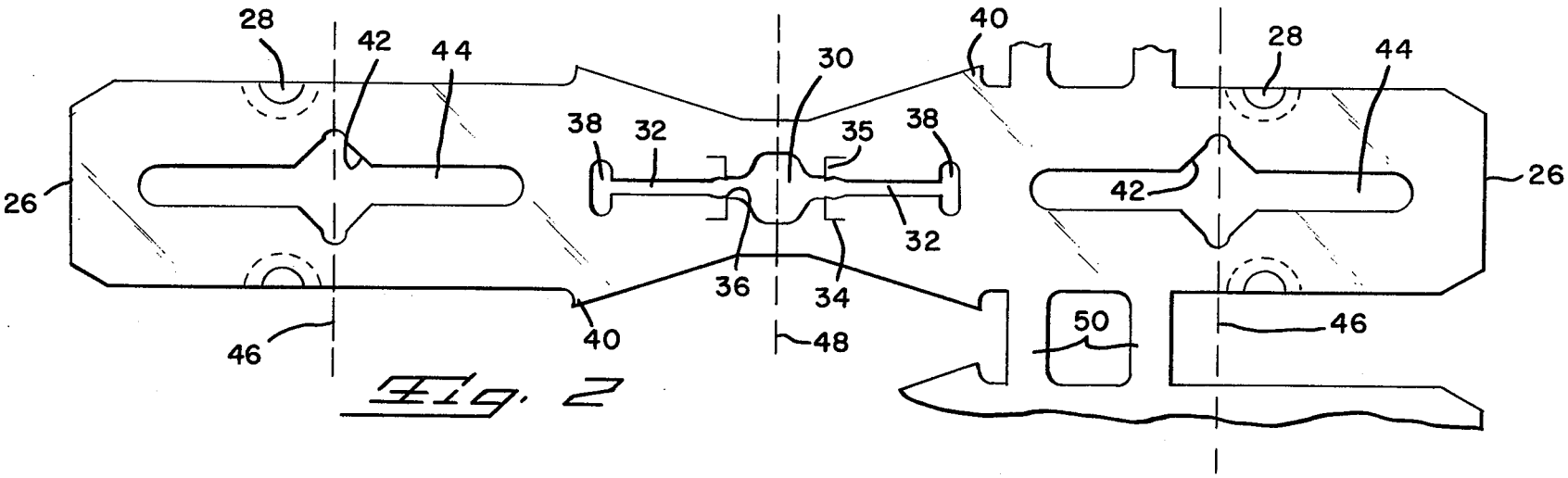
FIG. 2 is a plan view of the sheet metal blank from which the connecting device of FIG. 1 is formed.

Connecting devices 19 as shown in FIG. 1A are manufactured in the form of a continuous strip by blanking the strip as shown in FIG. 2, folding the side portions of the strip along the fold lines 46, and then folding each blank along the fold line 48. In FIG. 2, the parts of the blank are identified by the same reference numerals, differentiated by prime marks, which are used above in the description of the formed connecting device 19. Each blank is connected to the next adjacent blank by connecting strips 50 so that the finished strip can be wound on a reel and fed to an insertion apparatus which separates the leading connecting device from the strip and inserts it into a housing.

Each of the cavities 18 has opposed sidewalls 52, 54 against which the external surfaces of the sidewalls 22 of the connecting device 19 are disposed after the connecting device has been inserted into the cavity. The opposed end walls 56, 58 of the cavity have shallow grooves 60 adjacent to the sidewalls 52, 54 which receive the single metal thickness portions of the connecting device at the lower end thereof and the laterally extending retention ears 40. The width of the cavity is preferably such that these ears will dig into the endwalls 60 to retain the device in the cavity.

The inner end 70 of each cavity has a centrally located upwardly projecting boss 68 extending therefrom which is dimensioned to enter the opening 30 in the web 20 and to be received between the opposed surfaces of the sidewalls 22. The upper surface 69 of this boss acts as a stop or support for the fine wire 2 when a connecting device is inserted into the cavity. Slots 64 are provided in the sidewalls 52, 54 and these slots are enlarged at their upper ends 62 as shown in FIG. 5. The lower portion 64 of each slot is of a width sufficient to receive a fine wire 2 while the upper portion 62 is of a width sufficient to receive a coarse wire 4 as shown in FIG. 1.

At the time of assembly of the transformer shown in FIG. 1, the lead wires 2 from the coil 6 are positioned in the appropriate slots 62, 64 of the housing 16 and the individual connecting devices 19 are inserted into the cavities. At this time, the wires 2 move relatively into the slots 32 and electrical contact is established between the wires 2 and the terminal devices. At a later stage of the manufacturing process, connections are made with the conductors 4 by simply moving these conductors laterally of their axis through the openings 62 of the housings, and into the wire-receiving slots 44 of the connecting devices.

A signigicant feature of the invention is the fact that each terminal device 19 is capable of receiving an extremely fine wire 2 at one end thereof and a relatively coarse wire 4 at the other end thereof. Several features of the connecting device and the housing contribute to the achievement of this type of electrical connection. As previously mentioned, the connecting device 19 must be made of relatively thin stock metal since it must be provided with a relatively narrow slot 32 for the varnish insulated wire 2. The upper end of each connecting device, however, is rendered sufficiently strong and robust for the coarse wires 4 by virtue of the double stock thickness and the inwardly formed embossments 28. The embossments prevent collapse of the sidewalls towards each other during movement of the coarse wires into the slots and the upper portions of the sidewalls are supported against movement away from each other between walls 52, 54 of the housing.

The lower portion of the connecting device and the electrical connection therein to the fine wire is affectively protected against disturbance during movement of the coarse wire into the slots 44 because of the fact that the sidewalls are restricted from movement during movement of the coarse wire into the slots. Additionally, the shallow grooves 60 in the endwalls 56, 58 serve to stabilize the lower portions of the connecting device.

What is claimed is:

1. A double-ended electrical connecting device which is intended to receive a wire at each end thereof thereby to connect said wires to each other:

said connecting device having a U-shaped cross section comprising a web and sidewalls extending from said web, said sidewalls being reversely folded inwardly towards each other and towards said web whereby each of said sidewalls comprises inner and outer thickness of metal stock extending from the free ends of said sidewalls partially towards said web, a first wire-receiving opening in said web and a first wire-receiving slot in each of said sidewalls extending from said opening partially into said sidewalls, each of said sidewalls having a second wire-receiving slot extending inwardly from its free end in both of said metal thicknesses towards said web whereby, said wires are electrically connected to each other upon relative movement of said wires laterally of their axes into said first and second wire-receiving slots.

2. A connecting device as set forlth in claim 1, each of said inner thickness of metal stock having inwardly formed boss means thereon, said boss means being opposed to each other and serving as stop means.

3. A connecting device as set forth in claim 1, said first wire-receiving slots being intended for a relatively fine wire and having a width which is substantially equal to the thickness of the metal stock of said device.

4. A connecting device as set forth in claim 3, said second wire-receiving slots being intended to receive a relatively coarse wire and having a width which is significantly greater than the thickness of the metal stock of said device.

5. A double-ended stamped and formed electrical connecting device for connecting a coarse gage wire to a fine gage wire:

said connecting device being generally U-shaped and comprising a web and sidewalls extending from said web, said web constituting a fine wire connecting ends of said connecting device, a wire-receiving opening in said web and fine wire-receiving slots extending from said opening partially along said sidewalls whereby said connecting device can be connected to a fine wire by moving said fine wire laterally of its axis and into said fine wire-receiving slots, each of said sidewalls being inwardly reversely folded and comprising a double thickness of stock metal extending from the free edges of said sidewalls partially towards said web, each of said sidewalls having embossments proximate to said edges, said embossments of each sidewall extending towards and being against the embossments on the other one of said sidewalls, said embossments constituting stops which determine the thickness of said connecting device as measured between said sidewalls, each of said sidewalls having a coarse wire-receiving slot extending inwardly from its folded free edge partially towards said bight whereby, said connecting device can be connected to a coarse wire by moving said coarse wire laterally of its axis and into said coarse wire-receiving slots.

6. An electrical connection of a relatively fine wire having a varnish type insulation coating thereon to a relatively coarse wire comprising:

a connecting device having a U-shaped cross section comprising a web and sidewalls extending from said web, said sidewalls being reversely folded inwardly towards each other and towards said web whereby each of said sidewalls comprises inner and outer thicknessess of metal stock extending from the free ends of said sidewalls partially towards said web, a first wire-receiving opening in said web and a first wire-receiving slot in each of said sidewalls extending from said opening partially into said sidewalls, said first wire-receiving slots having a width which is less than the diameter of said fine wire, said fine wire being inserted into said slots and the opposed edges of said first wire-receiving slots having penetrated the insulation of said wire and established electrical contact therewith, each of said sidewalls having a second wire-receiving slot extending inwardly from its free end in both of said metal thicknesses partially towards said web, said second wire-receiving slots having a width which is less than the diameter of said coarse wire, said coarse wire being inserted into said second slots and being in electrical contact with the opposed edges of said second slots.

7. An electrical connection as set forth in claim 6, said connecting device having been formed from conductive stock metal having a thickness which is substantially equal to the width of said first slots.

8. An electrical connection as set forth in claim 7, including an insulating housing having a cavity extending therein from one surface thereof, said cavity having an inner end, said connecting device being disposed in said cavity with said web adjacent to said inner end.

9. An electrical connection as set forth in claim 8, said fine wire extending from a coil winding, said coarse wire serving to connect said coil to further circuitry.

* * * * *